United States Patent [19]

Ebihara et al.

[11] 4,192,135

[45] Mar. 11, 1980

[54] PORTABLE ELECTRONIC DEVICE

[75] Inventors: Heihachiro Ebihara; Fukuo Sekiya, both of Tokorozawa; Takashi Yamada, Sayama, all of Japan

[73] Assignee: Citizen Watch Company Limited, Japan

[21] Appl. No.: 863,469

[22] Filed: Dec. 22, 1977

[30] Foreign Application Priority Data

| | | | |
|---|---|---|---|
| Dec. 27, 1976 | [JP] | Japan | 51/157792 |
| Feb. 9, 1977 | [JP] | Japan | 52/13338 |
| Feb. 10, 1977 | [JP] | Japan | 52/15548[U] |

[51] Int. Cl.[2] ..... G04C 9/00

[52] U.S. Cl. ..... 368/62; 368/187

[58] Field of Search ..... 58/23 R, 85.5, 50 R, 58/152 R

[56] References Cited

U.S. PATENT DOCUMENTS

| | | | |
|---|---|---|---|
| 3,813,533 | 5/1974 | Cone et al. | 58/152 R |
| 4,033,108 | 7/1977 | Bennett et al. | 58/85.5 |
| 4,106,277 | 8/1978 | Garrison et al. | 58/50 R |
| 4,120,036 | 10/1978 | Maeda et al. | 58/85.5 |
| 4,120,040 | 10/1978 | Aihara | 58/50 R |

*Primary Examiner*—J. V. Truhe

*Assistant Examiner*—Forester W. Isen

[57] ABSTRACT

A portable electronic device equipped with a timepiece circuitry, which electronic device comprises a plurality of numeric keys adapted to provide numeric values corresponding to 0 through 9 when actuated. The numeric keys are utilized to correct a selected digit and once the numeric keys are actuated to complete a correction of the selected digit a shift will be made from the selected digit to another digit for a correction. The digit to be corrected is identified by a decimal point display segment which is automatically and cyclically shifted.

6 Claims, 25 Drawing Figures

PORTABLE ELECTRONIC DEVICE

This invention relates to portable electronic devices and, more particularly, to a portable electronic device equipped with timepiece and calculator functions.

As is well known, it has heretofore been proposed to provide portable electronic devices having timepiece and calculator functions. These are known as a portable electronic calculator timepiece. In conventional portable electronic calculator timepieces, it has been a usual practice to intermittently operate a time correction switch a number of times or over intermittent intervals in order to correct the time displayed by the display device. Since, in this expedient, the digit to be corrected is shifted by manipulating the other control member, a corrected digit is undesirably re-set in a case where there is an uncertainty about whether the digit for a correction has been shifted. Further, the correction operation takes a long time to perform and is thus extremely inconvenient. In the conventional portable electronic calculator timepieces, furthermore, it has been a common practice to suppress a 0 appearing in the tens digit of a time display. However, in such a portable electronic device where each digit can be corrected, there is always the fear that a suppressed digit which is not intended for a correction will be set unintentionally. Moreover, there are cases where a suppressed digit is overlooked and accidentally set to the value intended for another digit.

It is therefore an object of the present invention to provide a portable electronic device equipped with timepiece and calculator functions which can overcome the shortcomings encountered in prior art.

It is another object of the present invention to provide a portable electronic device in which a time display can be rapidly and accurately corrected through a simple operation.

It is another object of the present invention to provide a portable electronic device in which digits to be corrected are automatically shifted in a predetermined sequence whereby time correction can be easily and rapidly made.

It is still another object of the present invention to provide a portable electronic device in which a digit selected for a correction is released from the selected state once it has been set to a correct value so that the same digit need not be set in a redundant manner.

It is a further object of the present invention to provide a portable electronic device in which a correct value is directly set to a digit to be corrected by numeric keys provided in the portable electronic device and a troublesome repetitive operation is not necessary.

It is a further object of the present invention to provide a portable electronic device in which a digit to be corrected is automatically identified by a specific display indicia such as a decimal point display segment.

It is a further object of the present invention to provide a portable electronic device in which a 0 in the tens digit of a time display is suppressed in a normal timekeeping mode whereas in a time correction mode the 0 information in the tens digit of the time display is displayed to indicate that the electronic device is in the time correction mode for thereby eliminating accidental setting errors during the time correction mode.

These and other objects, features and advantages of the present invention will become more apparent from the following description when taken in conjunction with the accompanying drawings, in which.

Figure 5:
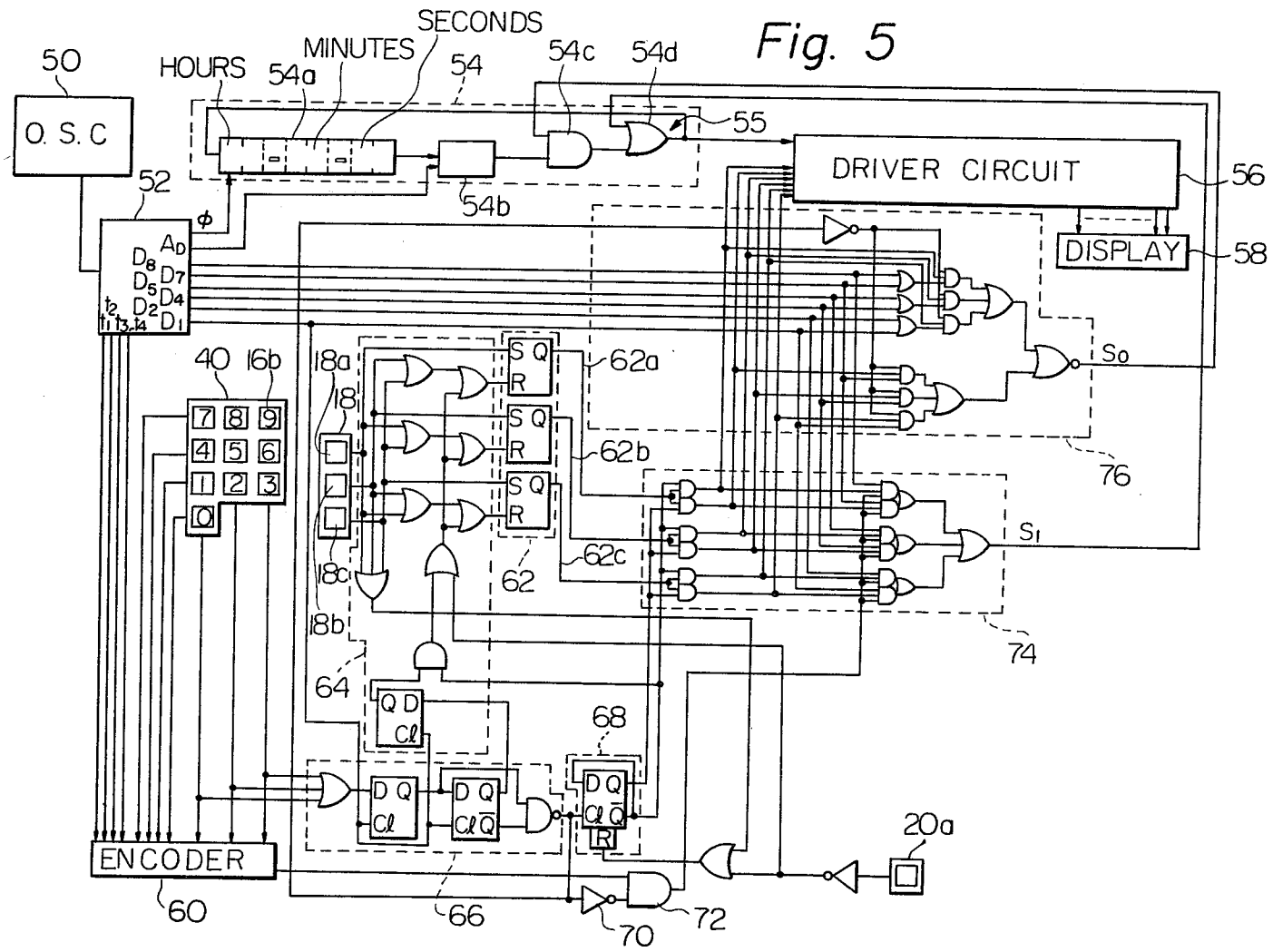
FIG. 5 is a block wiring diagram of a timepiece circuitry for the portable electronic device shown in FIG. 1.
Figure 6:
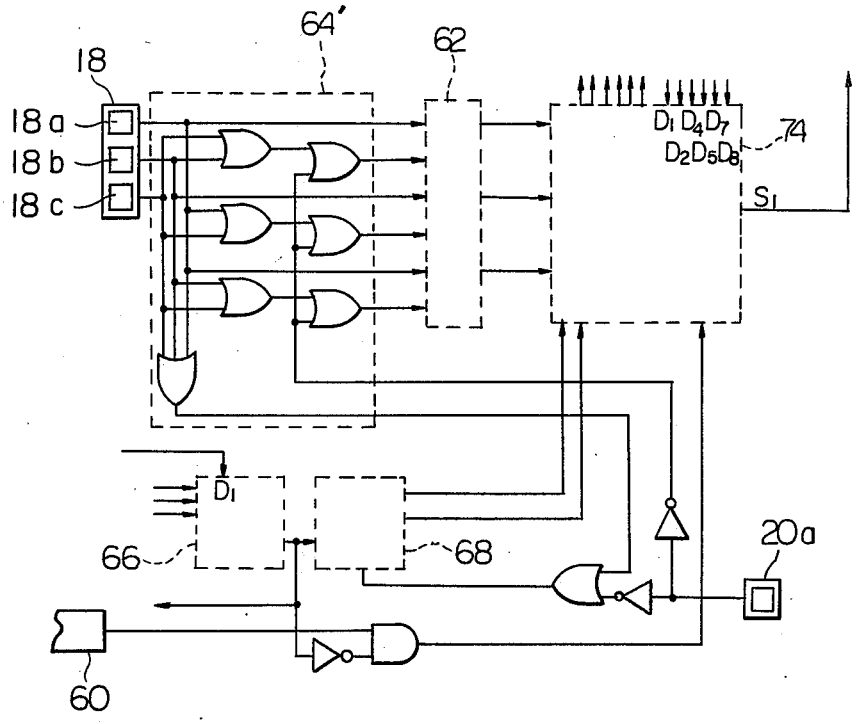
Figure 7:
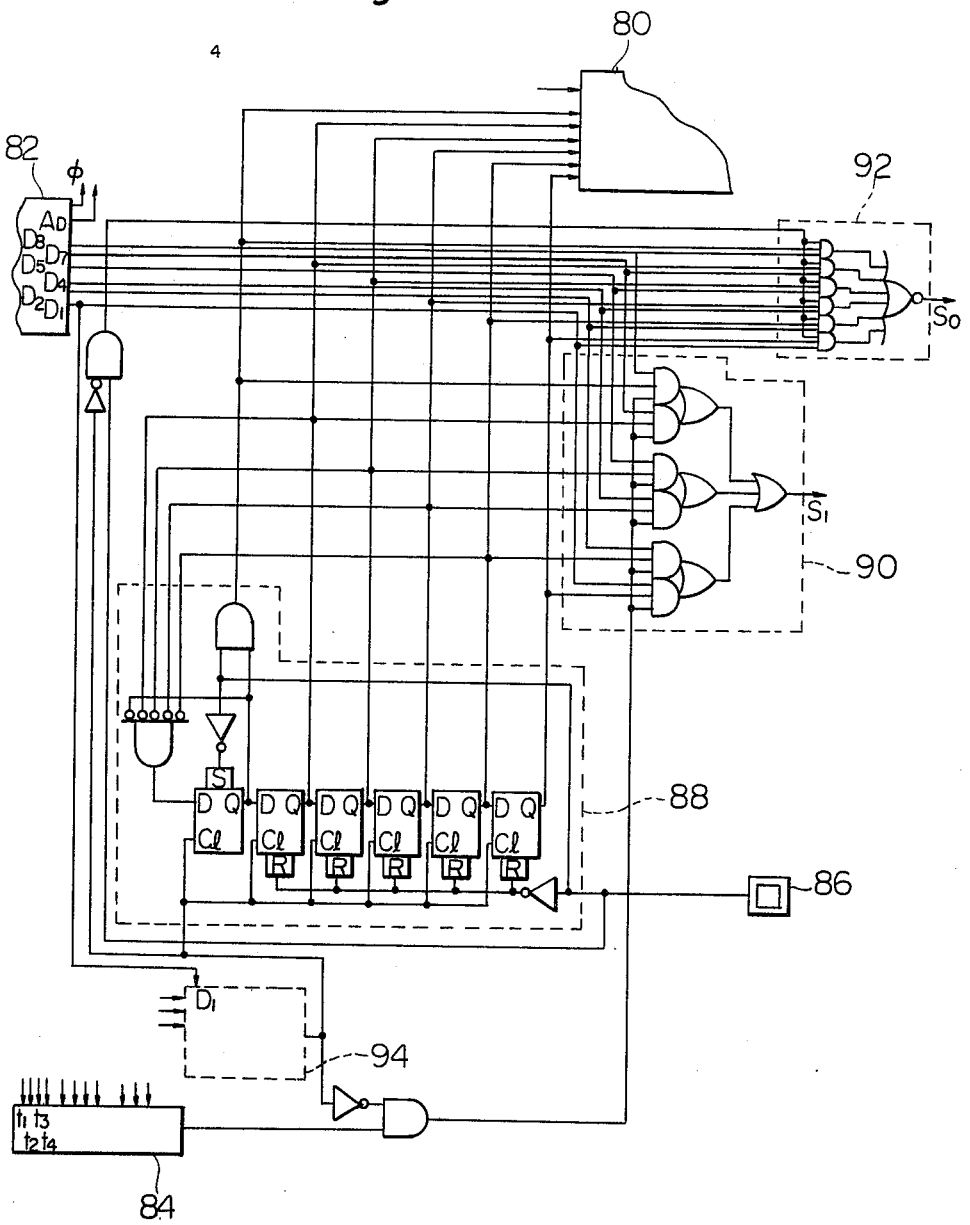
Figure 8:
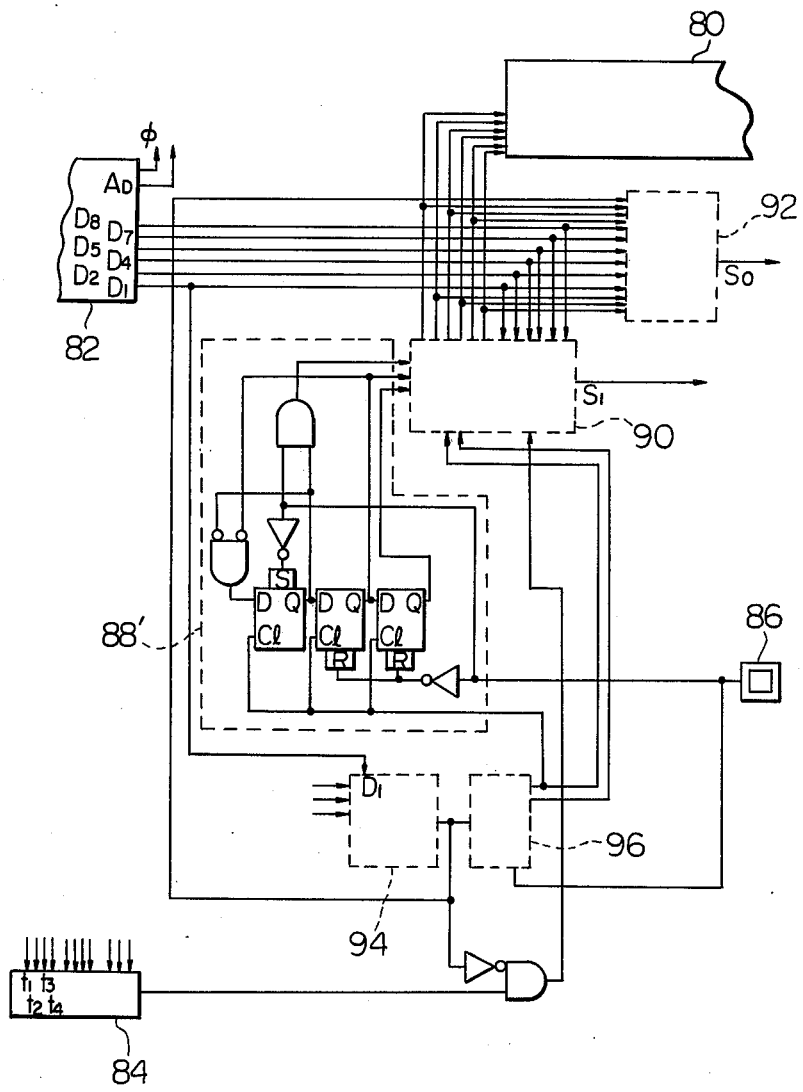
Figure 9:
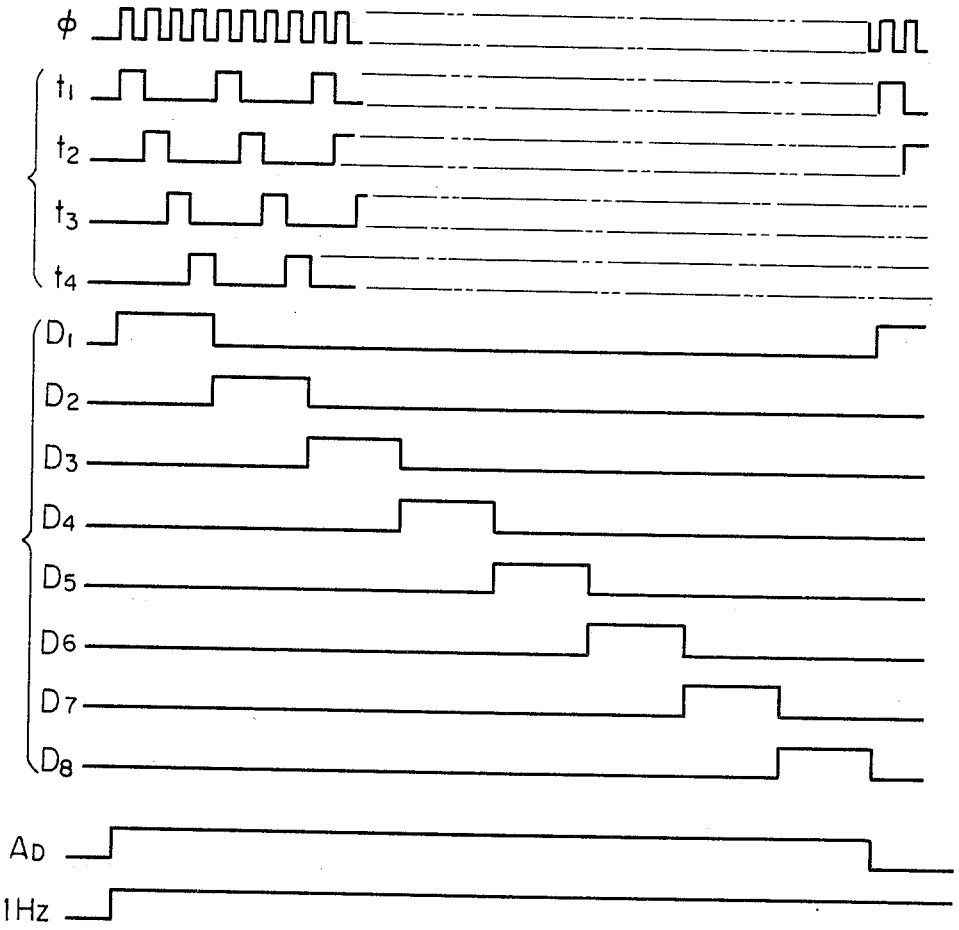
Figure 10:
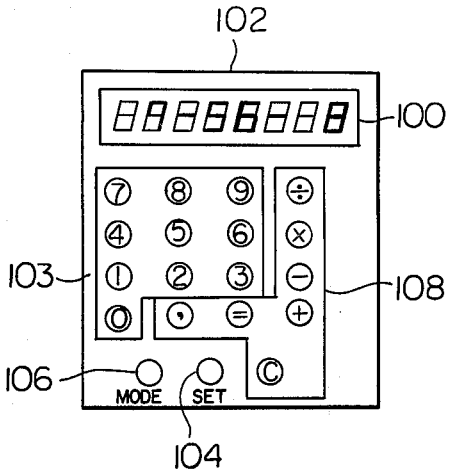
Figure 11A:
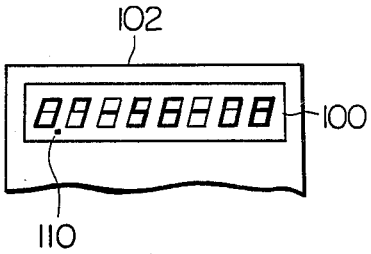
Figure 11B:
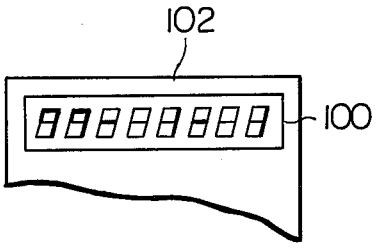
Figure 11C:
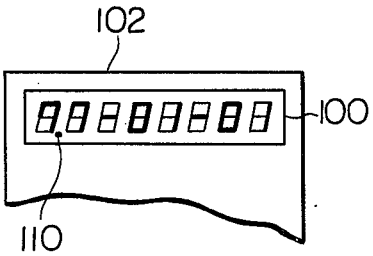
Figure 12:
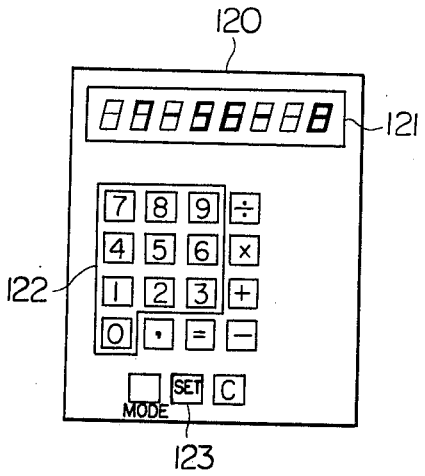
Figure 13:
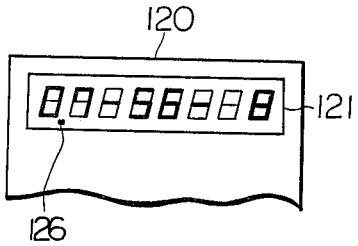
Figure 14:
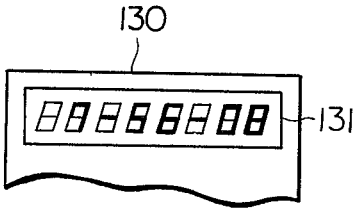
Figure 15:
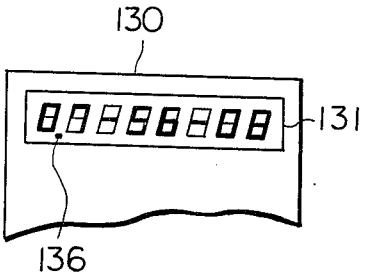
Figure 16:
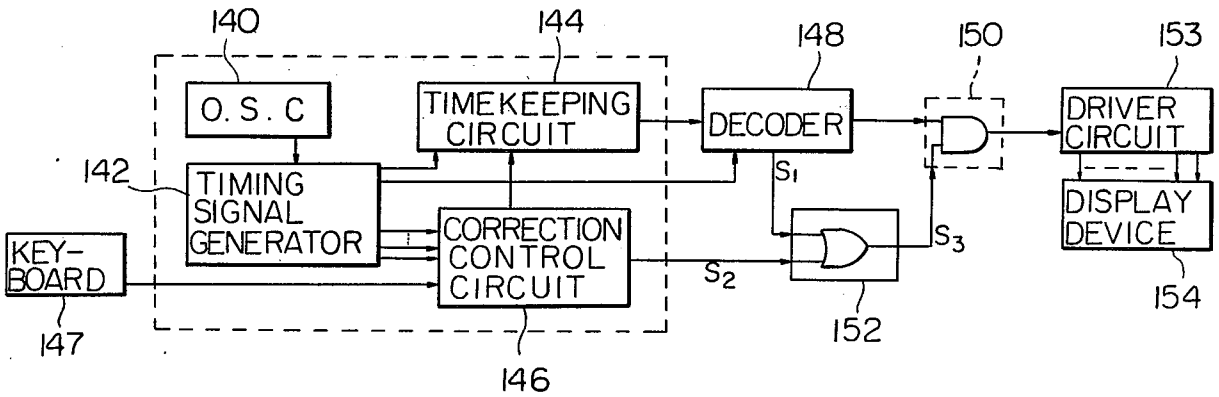
Figure 17A:
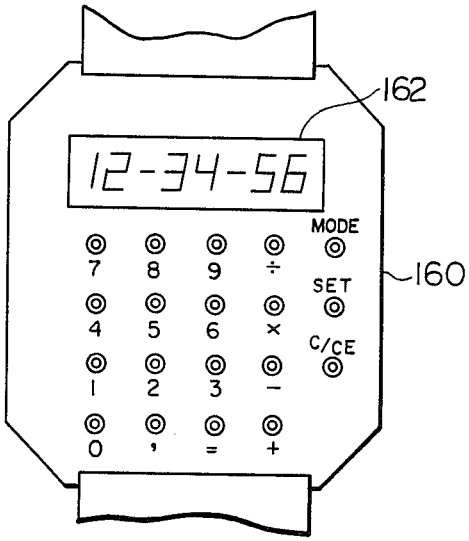
Figure 17B:
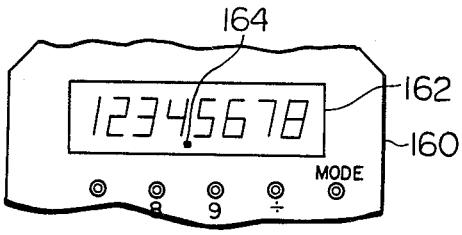
Figure 17C:
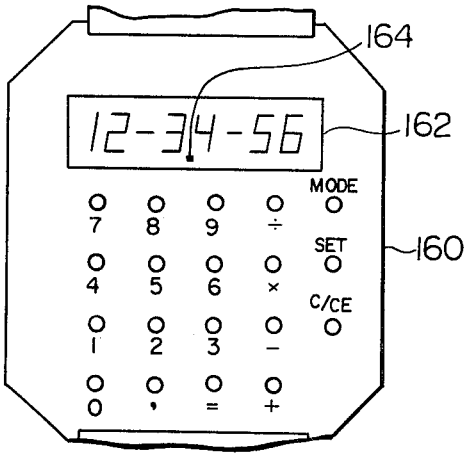

FIG. 6 partially shows a modified form of a portion of the timepiece circuitry shown in FIG. 5;

FIG. 7 is another modified form of a portion of the timepiece circuitry of FIG. 5;

FIG. 8 is still another modified form of a portion of the timepiece circuitry of FIG. 5;

FIG. 9 is a timing chart for various signals produced in the timepiece circuitry of FIG. 5;

FIG. 10 is a plan view of still another preferred embodiment of a portable electronic device according to the present invention;

FIGS. 11A to 11C show various display modes in a case where the portable electronic device of FIG. 10 is in a time correction mode;

FIG. 12 is a plan view of still another preferred embodiment of a portable electronic device according to the present invention;

FIGS. 13 to 15 show various display modes in a case where the portable electronic device of FIG. 12 is in a time correction mode;

FIG. 16 is a block wiring diagram of a timepiece circuitry for the portable electronic device shown in FIG. 10; and FIGS. 17A to 17C are fragmentary views of a modified form of a portable electronic device according to the present invention.

Figure 1:
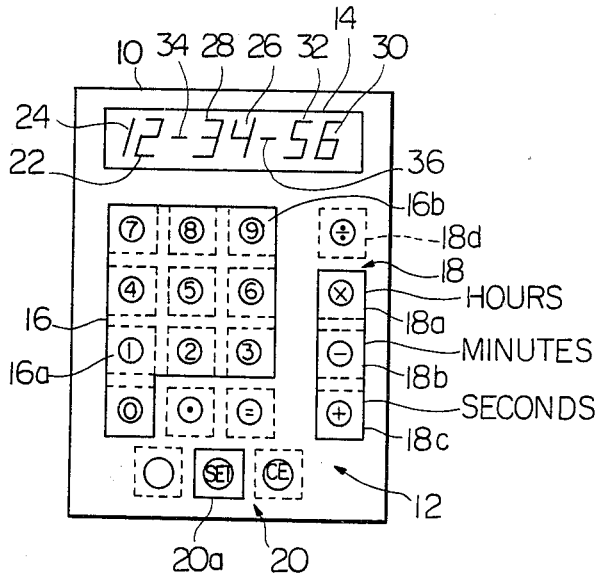
FIG. 1 is a plan view of a preferred embodiment of a portable electronic device according to the present invention, the portable electronic device being shown in its normal timekeeping mode.

Referring now to FIG. 1, there is shown a plan view of a preferred embodiment of a portable electronic device according to the present invention. The portable electronic device is shown as an electronic calculator timepiece, which generally comprises a case body 10, a keyboard 12, and a digital display device 14. The keyboard 12 comprises a plurality of numeric keys 16 adapted to input numeric values of 0 through 9 into a calculation circuit (not shown) during a calculating operation and input numeric values into a timepiece circuit (not shown) during a time correcting operation, a plurality of function keys 18 adapted to effect a desired function such as addition, subtraction, multiplication and division, etc., and a plurality of control keys 20 to control the calculation circuit or the timepiece circuit. In accordance with the present invention, the function keys 18 include a multiplication key 18*a*, a subtraction key 18*b*, an addition key 18*c*, and a division key 18*d*. Among these function keys, the multiplication key 18*a*, the subtraction key 18*b* and the addition key 18*c* serve as selection keys for selecting groups of two digits (including tens digit and units digit) to be corrected which represent time in terms of hours, minutes and seconds, respectively. The display device 14 serves to display time in a time display mode and calculations in a calculation mode. In FIG. 1, the display device 14 is shown as having a total of six digits and one set of bars. Six digits are in line, arranged in three groups of two digits each for the indication of hours 22, 24, minutes 26 and 28, and seconds 30, 32, respectively. Bars 34 and 36 separate the three groups from one another. Each groups of two digits will be referred to as a correction digit hereinafter. Thus, an hours correction digit means a units digit of hours and a tens digit of hours; a minutes correction digit includes a units digit of minutes and a tens digit of minutes; and a seconds correction digit includes a units digit of seconds and a tens digit of seconds. The control keys 20 include a setting key **20*a*** which serves as a change-over switch operable to change-over the display from a normal time read-out to a time correction read-out, and vice versa.

Figure 2A:
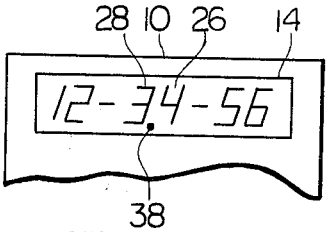
FIGS. 2A to 2D show a display device of the portable electronic device of FIG. 1, the portable electronic device being shown in its time correction mode.
Figure 2C:
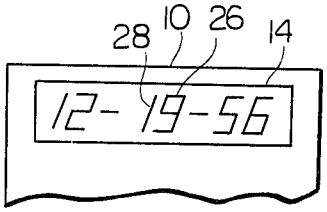
Figure 2B:
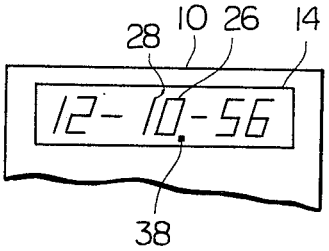

A time correction procedure is shown in FIGS. 2A through 2D. FIG. 2A shows the digital display device 14 for a case in which the minutes correction digit has been selected for a time correction by operating the minutes selection switch **18*b* after the time correction mode has been established by the change-over switch 20*a*. In the present embodiment, a decimal point display segment 38 is used to identify the tens digit of the minutes correction digit which has been selected for a correction. This indicates that the tens digit is now ready for a correction. FIG. 2B shows the digital display device 14 for a case in which the numeric key 16*a*, corresponding to the update value, has been depressed. In other words, if the numeric key 16*a* is depressed in the state shown in FIG. 2A, the units digit 26 of the minutes correction digit and the tens digit 28 are both reset to 0, and at the same time only the tens digit 28 is set to the value 1 corresponding to the numeric key 16*a*. Immediately after the tens digit 28 has been corrected to the value 1, the digit to be corrected is automatically shifted from the tens digit 28 to the units digit 26 of the minutes correction digit so that the unit digit 26** is ready for correction.

Figure 2D:
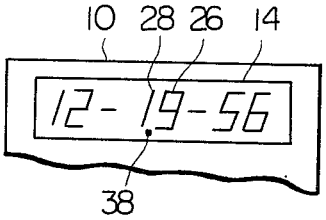

FIGS. 2C and 2D show the result of operating the numeric key **16*b*. Both diagrams show that the units digit of the minutes correction digit has been set to 9. In FIG. 2D, the minutes correction digit is released from the selected state immediately after the units digit 26 has been set to 9, so that the display device 14** is no longer in the correction mode. FIG. 2D, however, illustrates another example of the display device in which the correction digit are released from the selected state by a different system. In this example, immediately after the units digit of the minutes display is set to 9, the digit to be corrected is shifted from the units digit of the minutes display back to the tens digit, as is illustrated by the decimal point. Since the selected group of digits, i.e., the two minutes digits, have not been released from the selected state, the two digits can be set cyclically by operating the numeric keys.

Figure 3:
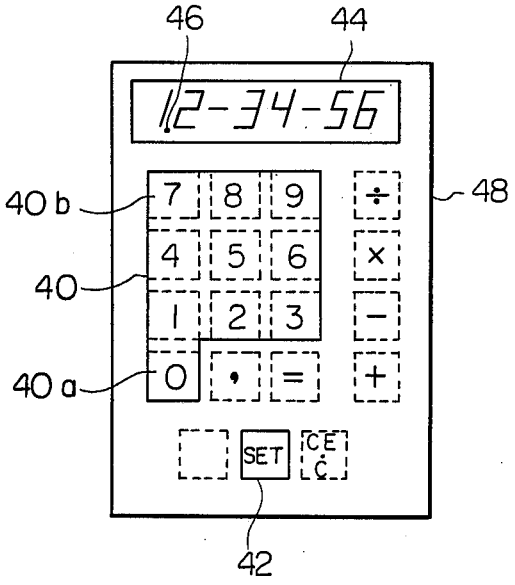
FIG. 3 is a plan view of another preferred embodiment of a portable electronic device according to the present invention.
Figure 4A:
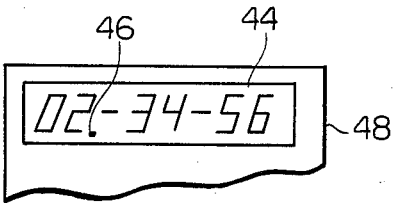
FIGS. 4A and 4B show a display device of the portable electronic device of FIG. 3, the portable electronic device being shown in its time correction mode.
Figure 4B:
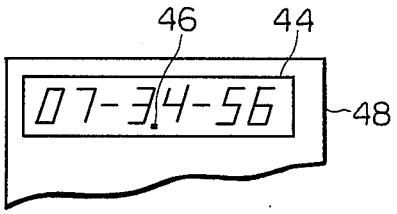

Another preferred embodiment of the electronic device according to the invention as depicted in FIG. 3 will now be described. Reference numeral 40 denotes a numeric key, 42 a change-over switch, 44 a digital display device, 46 a decimal display segment for identifying a digit to be set, and 48 a portable electronic device having calculation circuit means and timepiece circuit means according to the invention. With the device in a correction mode as shown in FIG. 3, numeric key **40*a* is depressed, whereupon the designated digit in FIG. 3 is set to 0, as shown in FIG. 4A, immediately after which the designation for a correction shifts to the next digit, as identified by the decimal point display element 46 in FIG. 4A. If numeric key 40*b* is now depressed, the digit selector for a correction in FIG. 4A is set to 7, as depicted in FIG. 4B. Immediately thereafter, the digit to be corrected is shifted to the next digit, as identified by the decimal point 46**. The digits to be corrected are thus shifted through a predetermined sequence so that time information can be set cyclically with respect to each digit.

The specific wiring diagram of a portion of the electronic device according to the invention will now be described with reference to FIG. 5. More specifically, FIG. 5 is a block wiring diagram which is mainly directed toward a timepiece circuitry of the portable electronic device described with reference to FIG. 1.

In FIG. 5, the timepiece circuitry of the electronic device is shown as comprising an oscillator 50 composed of a quartz crystal oscillator and serving as a frequency standard to provide a relatively high frequency signal, a timing signal generator 52 responsive to the relatively high frequency signal to provide a train of clock pulses $\phi$, a time unit signal AD having one second period, a plurality of bit signals t1 through t4 and a plurality of digit signals D1, D2, D4, D5, D7 and D8, a timekeeping circuit 54, a driver circuit 56 and a display device 58. The timekeeping circuit 54 is shown as comprising a shift register ring in which time data such as seconds, minutes and hours data are cyclically shifted in a serial manner in response to the train of clock pulses $\phi$ from the timing signal generator 52. The time data is updated in response to the time unit signal AD from the timing signal generator 52. To this end, the shift register ring comprises a shift register **54*a* driven in response to the clock pulses $\phi$, a serial adder circuit 54*b* connected to an output of the shift register 54*a* to update the data therefrom in response to the time unit signal AD, and a correction gate means 55 including a 0-set gate 54*c* having its one input coupled to an output of the serial adder circuit 54*b* and a 1-set gate 54*d* having its one input coupled to an output of the 0-set gate 54*c*. An output of the 1-set gate 54*d* is coupled to an input of the shift register 54*a*, thus constituting a shift register ring. The output of the 1-set gate 54*d* is also coupled to an input of the driver circuit 56. The driver circuit 56 may comprise a decoder circuit to provide decoded outputs in response to time data delivered from the timekeeping circuit 54, and a segment driver responsive to the decoded outputs to provide drive signals for driving segments of the display device 58. Reference numeral 40 denotes a set of numeric keys corresponding to values of 0 through 9. An encoder designated at 60 functions to convert the values which correspond to the numeric keys 40 to coded signals in response to the bit signals t1, t2, t3, t4 from timing signal generator 52. Selection keys 18 are adapted to select the groups of hours, minutes or seconds digits that are to be set when the electronic device is in the time correction mode, and comprise an hours selection key 18*a*, minutes selection key 18*b* and seconds selection key 18*c*. These keys 18*a*, 18*b*, 18*c* also serve as "x", "−" and "+" function keys, respectively, when the electronic device is in the calculation mode. A memory circuit 62 memorizes the operation of each selection key, i.e., a selected correction digit and is reset whenever a selection key of another function is depressed, or when the device is returned to the normal time-keeping mode. The memory circuit 62 is reset by a reset circuit 64 after a given digit has been corrected by a value chosen by a selected numeric key, that is, on the second operation of a numeric key. A detector circuit 66 detects the operation of the numeric keys. The detector circuit 66 is supplied with the digit signal D1 which is in synchronism with the 1st digit of the shift register 54***a*, and is adapted, upon each operation of a numeric key, to supply a counter 68 with a signal of a pulse width (a 1-work cycle) which shifts all the bits of the shift register 54*a*. The 1-word cycle pulse signal is inverted by inverter 70 and applied to a gate circuit 72 to which the coded signal from the encoder 60 is also applied. Counter 68 comprises a positive-going trigger-type toggle flip-flop which counts the signals produced by the numeric keys, and decides whether the depression of a numeric key is the first or second depression. The counter 68 is reset when the electronic device is returned to the normal time-keeping mode, or upon each operation of a selection key. Indicated as 74 is a correction digit control circuit which selects the correction digits, i.e., groups of digits which are to be corrected, in response to the selection signals which have been memorized by memory circuit 62, and the signal from counter 68 which indicates that a numeric key has been depressed once or twice. The control circuit 74 also controls the coded signals of one word cycle in response to signals indicative of selected correction digits and the digit signals D1, D2,D4,D5,D7,D8 as provided by the timing signal generator 52, and supplies output signals indicative of the selected correction digit to the driver circuit 56 so as to excite the decimal point display segment.

Reference numeral 76 designates a 0-set signal generator which supplies a 0-set signal So to both digits of a group which have been selected for a correction, in response to a signal generated by the counter circuit 68 and indicative of a first operation of the numeric keys; if the signal from the counter circuit 68 is indicative of a second operation, a 0-set signal is applied to only the digit of a selected group to be corrected. These 0-set signals, designated by So, are coupled to another input of the 0-set gate 54*c*. The control circuit 74 generates an output signal S1, which is applied to the 1-set gate 54*d* so that a numeric value corresponding to the depressed numeric key is set to the digit which has been previously cleared by the 0-set gate 54*c* in response to the signal So. Reference numeral 20*a* denotes a change-over switch for switching between the normal time-keeping and time correction modes.

The operation of the circuit shown in FIG. 5 will now be described according to the setting procedure already explained with regard to FIG. 1. As described above, FIG. 1 shows the display in the normal time-keeping mode; at such time, the memory circuit 62 and counter circuit 68 of FIG. 5 are in the reset state. Next, when the display is placed in the state shown in FIG. 2A by depressing the minutes selection key 18*b* after the time correction mode has been established by the change-over switch 20*a*, the memory circuit 62 and counter circuit 68 in FIG. 5 are released from the reset state, and memory circuit 62 memorizes the fact that the minutes selection key 18*b* has been depressed. A memory signal indicative of a minutes digit and a signal indicative of the first numeric key operation are applied to the control circuit 74 to select the tens digit of the minutes display as the correction digit; hence, the control circuit supplies the driver circuit 56 with a signal that will identify said correction digit by means of the decimal point display segment. Next, FIG. 2B shows that numeric key 16*a* has been depressed to correct the tens digit of the minutes digits to a value of 1. To this end, in FIG. 5, the encoder 60 generates a coded signal indicative of 1 when the numeric key 16*a* is depressed. This coded signal is applied through gate 72 to the control circuit 74, which generates an output signal S1-1 in response to the digit selection signal 62*b* from the memory circuit 62 and the digit signal D5 indicative of the tens digit of the minutes display. The 0-set gate 54*c* is provided with a signal So that sets to 0 the tens digit and units digit of the pair of digits in the minutes display, and the output signal S1-1 is applied to the 1-set gate 54*d* of the time-keeping circuit 54 so that the tens digit of the minutes display is set to "1". The respective 0-set and 1-set operations are completed over one word cycle, immediately whereafter the counter 68 produces a signal indicative of a second numeric key operation, so that the digit to be corrected now shifts to the units digit of the minutes display. Now, in FIG. 2C, the display device 14 shows that a numeric key 16*b* is depressed for the second time. In FIG. 5, the encoder 60 generates a coded signal representative of 9 when the numeric key 16*b* is depressed. This coded signal is applied though gate 72 to the control circuit 74, which generates an output signal S1-9 in response to the digit selection signal 62*b* and the digit signal D4. The output signal S1-9 is applied to the 1-set gate 54*d* of the timekeeping circuit 54 so that the units digit of the minutes digits is set to "9". Immediately thereafter, counter circuit 68 generates a signal indicative of a first numeric key operation, whereby the memory circuit 62 is reset by this signal and a signal which is generated one word cycle at the completion of the setting operation.

It should be understood that the above description for setting the minutes display also applies to the hours and seconds displays, and that a date correction can be accomplished in the same manner if the shift register 54*a* of the timekeeping circuit 54 also contains date information.

FIG. 6 shows a modified form of a part shown in FIG. 5. In FIG. 6, the selection keys 18, memory circuit 62, detector circuit 66, counter circuit 68 and control circuit 74 are exactly the same as those in FIG. 5. The timekeeping circuit, although not shown, also possesses the same structure as that shown in FIG. 5. Reset circuit 64', which in the present embodiment is constructed differently from that in FIG. 5, does not include a reset signal generator responsive to a signal from counter 68 indicative of a first numeric key operation, and a signal which arrives after the completion of a correction; here, a reset signal is generated only when the electronic device is returned to the normal timekeeping mode, or when a selection key of a different function is depressed. Hence, when numeric key 16*b* is operated with the display device in the state illustrated in FIG. 2B, 9 is set to the units of the minutes digits, immediately whereafter counter 68 produces a signal indicative of a first key operation, whereby the tens digit is now selected for a correction, as shown in FIG. 2D. Thus, whenever a numeric key is depressed, the digit which is selected for a correction will shift back and forth between a group of digits, as in the minutes display in this example, in response to changes in the output of the counter circuit 68. Accordingly, digits can be set in a cyclic manner.

FIG. 7 illustrate another modification of a part shown in FIG. 5. In the modification of FIG. 7, the circuitry permits a digit selected for a correction to be shifted through a predetermined sequence by operating the numeric keys when the electronic device has been placed in the time correction mode. A display driver circuit 80, timing generator 82, encoder 84 and change-over switch 86 are exactly identical to the corresponding components 56, 52, 60 and 20*a* already described with respect to FIG. 5. The timekeeping circuit, although not shown, also possesses and identical circuit arrangement. In place of the memory circuit 62, there is provided a serial-in parallel-out type shift register 88 which is employed as a memory circuit for the selected digits and which possesses an output terminal for each digit, the shift register being adapted to provide at each output terminal a signal which selects a digit which is capable of being corrected. These signals are coupled to the control device 90 and the driver circuit 80, wherein the signals serve to excite a decimal point display segment to identify a selected digit. In this modification, when the electronic device is in the normal timekeeping mode, five bits of the shift register 88 are reset and one bit is set; whereas, in the time correction mode, these states are released. The time correction procedure is as described with reference to FIGS. 3 and 4A to 4D; namely, the digit selected for a correction is located at the left side of the display device 44, i.e., the tens digit of the hours digits and is set to 0 by operating numeric key 40*a*. Immediately thereafter, each bit of data in shift register 88 undergoes a one-bit shift so that the next digit in line is selected for a correction as shown by decimal point segment 46 in FIG. 4A. In this case, if the numeric key 40*b* is depressed, 7 is established as the units digit of the hours digits, and the digit selected for a correction shifts to the tens digit of the minutes display as shown in FIG. 4B. In this embodiment, only the digit selected for a correction is set to 0 by the 0-set signal So supplied by a 0-set circuit 92.

The shift register 88 can be replaced by a three bit shift register 88' as shown in FIG. 8 which shows a modification of the circuit shown in FIG. 7. In the modification of FIG. 8, the timing generator 82, encoder 84, detector circuit 94, counter 96, control device 90, 0-set circuit 92, and change-over switch 86 may be exactly the same as constructed in FIG. 5, although the timekeeping circuit is not shown.

FIG. 9 is a timing chart showing the timing relationships among the high speed clock pulses $\phi$ that cause the shift register 54*a* to shift, the bit signals t1, t2, t3, t4, digit signals D1, D2, D3, D4, D5, D6, D7, D8, and the calculation instruction signal or time unit signal AD. The shift register of the timekeeping circuit is shifted one bit at a time by the positive-going clock pulse $\phi$. One digit is defined by four bits by which a BCD code is constituted. The bit signals are in synchronism with the respective bits of the shift register 54*a* and are used when one digit is to be represented in the form of the four bit BCD code. The digit signals are in synchronism with the respective digits of the shift register 54*a* and are produced only over a time period in which the digits are passed by 0-set and 1-set gates 54*c* and 54*d*. In the embodiment of FIG. 5, the units digit of the seconds display passes through the 0-set and 1-set gates 54*c*, 54*d* in synchronism with D1, and the tens digit in synchronism with D2. Likewise, the units digit of the minutes display passes through the 0-set and 1-set gates in synchronism with D4, the tens digit with D5, the units digit of the hours display with D7, and the tens digit with D8.

In accordance with the present invention, a digit selected for a correction is released from the selected state once it has been set to the correct value so that the same digit need not be set in a redundant manner. Since the correct value is directly set by the numeric keys, a troublesome repetitive operation is not necessary. The correct time may be set in the seconds display by selecting the second digits and using a ten-second time tone provided by a telephone time service or the like. It is of course also possible to perform a correction by cyclically selecting a group of selected digits in either of the hours, minutes or seconds displays, or by shifting a selected digit from one digit to the next through a predetermined sequence by depressing the numeric keys without selecting any particular groups of digits. Finally, the embodiments described make use of a decimal point display segment to identify a selected digit; however, a system can also be adopted in which the selected digit is caused to flicker, or a display element of another kind may be used.

FIG. 10 is an external view of another preferred embodiment of a portable electronic device according to the present invention. The electronic device has a digital display device 100, numeric keys 103 for setting numerical values, and a change-over switch 104 for changing over between a normal time-keeping mode and a time correction mode. In this illustrated embodiment, the electronic device is also equipped with calender display means for years, months and date information and calculation means in addition to the time display means for hours, minutes and seconds information. A mode selection switch for actuating these means is designated at reference numeral 106. Reference numeral 108 denotes function keys which are used to effect calculations. The device illustrated in FIG. 10 is shown in the normal time-keeping state in which a time of 7:56:8 is displayed as 7-56-8 on the display device 100. It can readily be seen that the 0 time information that would otherwise appear in the tens digit of the hours display and the tens digit of the seconds display is suppressed by the operation of means provided for this purpose.

FIG. 11A shows the display portion of the electronic device 102 after it has been placed in the time correction mode by depressing the change-over switch 104. The digital time display device 100 now displays the time with the inclusion of the 0 information corresponding to the tens digits; i.e., the display readout is now 0.7-56-08. At the same time, a decimal point display segment 110 appears so as to identify the tens digit of the hours display as the correction digit which is to be corrected.

FIG. 11B shows the electronic device after it has been placed in the calendar display mode by depressing mode selection switch 106. The electronic device is in the normal time-keeping state and, as was the case with the time display, information indicative of a date of Jan. 1st, 1977 is displayed as 77-1-1, namely with a 0-suppress in effect for the tens digits of the months and date displays.

FIG. 11C shows the electronic device after it has been placed in the correction mode by depressing change-over switch 104. The electronic device now displays the calendar information with the inclusion of the 0 information in the tens digit of the months display and the tens digit of the date display; i.e., the display readout is now 7.7-01-01. At the same time, the decimal point display segment 110 appears so as to identify the tens digit of the years display as the correction digit which is to be corrected or set.

FIG. 12 illustrates a modified form of the portable electronic device shown in FIG. 10. In FIG. 12, the electronic device 120 is shown in the normal time-keeping state while displaying the same time information, 7-56-8, shown in FIG. 10.

FIG. 13 shows the electronic device after it has been placed in the time correction state by operating the change-over switch 123. In this case, a 0 will be displayed as the tens digit for a digit which has been selected for a correction, but will be suppressed for any non-selected digit. Hence, the digital display device 121 shows a readout of 0.7-56-8.

In FIG. 14, a portable electronic device 130, shown in the normal time-keeping state, includes means for suppressing the 0 in the tens digit of the hours display. When the electronic device is placed in the time correction state, as shown in FIG. 15, said means is rendered inoperative so that no 0-suppress is effected for the tens digit which is identified by the decimal point display segment 136. The 0 information is thus displayed as the tens digit of the hours display.

In the portable electronic device shown in FIGS. 10 to 15, it is difficult to overlook a digit to be corrected and thus set it accidentally since the digit to be corrected is always displayed when the electronic device is in the correction mode. Furthermore, since the tens digit of the hours display in an electronic device equipped with a 12-hour clock is in a state of non-display for a comparatively long period of time, a 0 when displayed as the tens digit of the hours display provides one more indication that the electronic device is in the time correction mode.

For a description of the related circuitry, reference will now be had to FIG. 16, which shows a block wiring diagram of a timepiece circuitry forming part of the portable electronic device shown in FIG. 10. The timepiece is shown as comprising an oscillator 140 controlled by a quartz crystal to provide a relatively high frequency signal, a timing signal generator 142 responsive to the relatively high frequency signal to provide a train of clock pulses for shifting the time information at high speed, digit signals in synchronism with respective digits of the time information shifted by the clock pulses, bit signals by which each digit signal is defined, and timing signals, a timekeeping circuit 144 composed of a shift register ring in which the time information is cyclically shifted in response to the clock pulses, and a correction control circuit 146 coupled to the timekeeping circuit 144 to normally update the time information cyclically shifted through the shift register ring in response to the time unit signal from the timing signal generator 142 and selectively permit correction of the time information in response to input signals from a keyboard 148. The keyboard 147 comprises numeric keys as well as a change-over switch which allows the correction control circuit 146 to be externally controlled. A decoder 148 decodes the time information from the timekeeping circuit 144 into signals for exciting a 7-segment display, and generates a detection signal S1, in response to the tens digit timing signal from timing signal generator 142, upon detecting that the content of the tens digit time information, such as the tens digit of the hours or minutes display, is 0. The decoded 7-segment display signals from the decoder 148 are fed to a gate 150. A display control circuit 152 for tens digits is supplied with the detection signal S1 from decoder 148, and with a signal S2 delivered by the correction control circuit 146 and indicative of the time correction state. The display control circuit 152 produces a display control signal S3 which excites the tens digits, in response to the detection signal S1 and the signal S2. In terms of logic levels, the detection signal S1, once the tens digits of the time information has been decoded, is at an L logic level if the content of the tens digit is 0, and at an H level if said content is a value other than 0. When the content of the tens digit is 0, the detection signal S1 goes to an L level, and the 7-segment signal for exciting the tens digit is inhibited by the gate 150. When a time correction is made possible by the correction control circuit 146, signal S2 attains an H logic level; the signal is at an L level during the normal timekeeping mode. The gate 150 comprises an AND gate which controls the 7-segment signals in response to the display control signal S3. It goes without saying that the detection signal S1 and the signal S2 are both at an L level if the electronic device is in the normal time-keeping mode and the content of the tens digit is 0. If this is the case, display control signal S3 attains an L logic level; hence, AND gate 150 closes, blocks the 7-segment signals. If the display control signal S3 attains a H level at the same time that the 7-segment signal for the tens digit completes its passage through the AND gate 150, the gate is allowed to pass a 7-segment signal for another digit. The display made possible by this 7-segment signal is as illustrated in FIG. 10. Now, if the time correction state is selected, signal S2 attains an H level, thereby raising display correction signal S3 to an H level. Hence, gate 150 is allowed to pass all of the 7-segment signals. This provides the display depicted in FIG. 11A. A driver circuit designated at 153 temporarity latches the 7-segment signal controlled by gate 150 and converts this signal to segment display signals in a parallel form. Designated at reference numeral 154 is a display device which displays the signals provided by the driver circuit 153.

The above description of the time display mode will also hold for the calendar display mode.

The modification of the invention as depicted in FIGS. 12 and 13 will now be briefly described using the circuitry of FIG. 16. In the electronic device shown in FIGS. 12 and 13, the 0's in the tens digits of the display will be suppressed, even if the device is in the correction mode and 0 information is present in the tens digits, unless a tens digit has been selected for a correction. Accordingly, instead of the display control circuit 152 obtaining from the correction control circuit 146 a signal indicative of the correction state, the display control circuit 152 will be supplied with a signal that is at an H level only when the content of a digit to be corrected or set is passed by gate 150. The remaining sections of the circuit shown in FIG. 16 need not be altered or changed.

In the electronic device shown in FIGS. 10 to 16, the provision of the display control circuit for the tens digits virtually eliminates accidental setting errors during the time correction state and provides an additional indication that the device is in the time correction state.

FIGS. 17A to 17C show another modification of a portable electronic device according to the present invention. The portable electronic device is shown as actually comprising an electronic calculator watch having a case 160 and a display device 162. The display device 162 provides a display of 12-34-56 corresponding to 12 hours, 34 minutes and 56 seconds in FIG. 17A which shows a normal timekeeping mode. The display device 162 has a decimal point display segment 164 which is excited during a calculation mode as shown in FIG. 17B. This decimal point display segment 164 is used for identifying the digit to be corrected as indicated in FIG. 17C. In FIG. 17C, the tens digit of the minutes display is shown as in a state to be corrected. The decimal point display segment 164 may be flashed during a time correction mode to more clearly identify the digit to be corrected.

While the present invention has been shown and described with reference to particular embodiments, it should be noted that various other change or modifications may be made without departing from the scope of the present invention.

What is claimed is:

1. In a portable electronic device having timepiece circuitry including a frequency standard providing a relatively high frequency signal, a timing signal generator responsive to the relatively high frequency signal, to provide a time unit signal, a timekeeping circuit responsive to the time unit to provide time data, a driver circuit responsive to the time data to provide drive signals and a display device responsive to the drive signal to provide a display of time by means of a plurality of groups of digits with each of said groups of digits comprising a units digit and a tens digit, the improvement comprising:

a plurality of numeric keys, each of said numeric keys providing a numeric signal when actuated;

a plurality of switch means, each of said switch means providing a digit selection signal corresponding to one of said groups of digits when actuated;

correction gate means provided in said timekeeping circuit;

detection and counter means responsive to said numeric signal for detecting at least two successive actuations of said numeric keys and for producing output signals indicative thereof; and control circuit means responsive to said digit selection signal for generating an output signal indicative of one only of the units digit and tens digit of a group of digits selected for correction, and including means for applying said numeric signal to said correction gate means to correct said selected digit to a value corresponding to said numeric signal, and further responsive to an output signal from said detection and counter means for automatically shifting to select the as yet uncorrected one of said units digit and tens digit, whereby a numeric signal produced by a subsequent actuation of said numeric keys is applied to said correction gate means to correct said as yet uncorrected digit.

2. The improvement according to claim 1, wherein said control circuit means is responsive to said digit selection signal for generating a first output signal indicative of a selected digit comprising one of the units digit and tens digit of said selected group of digits to be corrected, and includes means for applying a first numeric signal generated by a first actuation of said numeric keys to said correction gate means in response to said first output signal, for thereby causing said correction gate means to correct said selected digit to a value corresponding to said first numeric signal, and is further responsive to said digit selection signal in conjunction with an output signal from said detection and counter circuit means indicative of said first actuation of said numeric keys for generating a second output signal indicative of the as yet uncorrected digit of said selected group of digits, and further comprises means for applying a second numeric signal generated by a second actuation of said numeric keys to said correction gate means in response to said second output signal, to thereby correct said as yet uncorrected digit to a value corresponding to said second numeric signal.

3. The improvement according to claim 1, in which said control circuit means further comprises means for cyclically selecting said units digit and tens digit of said selected group of digits to be corrected, in response to output signals produced by said detection and counter means as a result of successive actuations of said numeric keys.

4. The improvement according to claim 1, in which said display device has a display indicia to indicate said selected digit, and further comprising means for automatically shifting said display indicia to the as yet uncorrected digit of said selected group of digits, when one digit of a selected group of digits, has been corrected.

5. The improvement according to claim 4, in which said display device has a display indicia to indicate said selected digit, and further comprising means for cyclically shifting said display indicia between the units digit and tens digit of said selected group of digits in response to successive actuations of said numeric keys.

6. In a portable electronic device having timepiece circuitry including a frequency standard providing a relatively high frequency signal, a timing signal generator responsive to the relatively high frequency signal to provide a time unit signal, a timekeeping circuit responsive to the time unit signal to provide time data, a driver circuit responsive to the time data to provide drive signals and a display device responsive to the drive signal to provide a display of time by means of a plurality of groups of digits with each of said groups of digits comprising a units digit and a tens digit, the improvement comprising:

a plurality of numeric keys, each of said numeric keys providing a numeric signal when actuated;

a plurality of switch means, each of said switch means providing a digit selection signal corresponding to one of said groups of digits when actuated;

correction gate means provided in said timekeeping circuit;

detection and counter means responsive to said numeric signal for detecting at least two successive actuations of said numeric keys and for producing output signals indicative thereof;

control means responsive to said digit selection signal for generating an output signal indicative of one only of the units digit and tens digit of a group of digits selected for correction, and including means for applying said numeric signal to said correction gate means, to correct said selected digit to a value corresponding to said numeric signal, and further responsive to an output signal from said detection and counter means for automatically shifting to select the as yet uncorrected one of said units digit and tens digit of said selected group of digits, whereby a numeric signal produced by a subsequent actuation of said numeric keys is applied to said correction gate means to correct said as yet uncorrected digit; and means for inhibiting zero suppression of the tens digit of said group of digits selected for correction, while enabling zero suppression of the tens digits of groups of digits which have not been selected for correction.

* * * * *